US008302978B2

(12) United States Patent
You et al.

(10) Patent No.: US 8,302,978 B2
(45) Date of Patent: Nov. 6, 2012

(54) BABY WALKER WITH A USE-TRANSFERABLE UPPER TRAY

(75) Inventors: Youn-Fu You, Chang Hua (TW); Chia-Ming Shen, Kaohsiung (TW); Kuang-Neng Cheng, Chiayi County (TW)

(73) Assignee: Lerado (Zhong Shan) Industrial Co., Ltd., Zhong Shan, Guang Dong Province (CN)

( * ) Notice: Subject to any disclaimer, the term of this patent is extended or adjusted under 35 U.S.C. 154(b) by 0 days.

(21) Appl. No.: 13/188,219

(22) Filed: Jul. 21, 2011

(65) Prior Publication Data

US 2012/0018971 A1 Jan. 26, 2012

(30) Foreign Application Priority Data

Jul. 22, 2010 (CN) ..... 2010 2 0268412 U

(51) Int. Cl.
*B62B 7/00* (2006.01)

(52) U.S. Cl. ..... 280/87.051; 280/650; 280/647

(58) Field of Classification Search ..... 280/87.021, 280/87.041, 87.051, 87.03; 482/66, 77, 78; 297/136, 5, 174 R
See application file for complete search history.

(56) References Cited

U.S. PATENT DOCUMENTS 592,569 A * 10/1897 Lehmann ..... 472/15
5,688,211 A * 11/1997 Myers ..... 482/66
8,104,780 B1 * 1/2012 McConnell-Copploe et al. ..... 280/87.051

* cited by examiner

*Primary Examiner* — J. Allen Shriver, II
*Assistant Examiner* — James Triggs
(74) *Attorney, Agent, or Firm* — Morris, Manning & Martin, LLP; Tim Tingkang Xia, Esq.

(57) ABSTRACT

A baby walker with a use-transferable upper tray comprises an upper tray, a base, a pair of side posts and a positioning mechanism. The upper tray is positioned by the positioning mechanism in a first position or a second position and being connected with a seat for accommodating a baby-occupant. The base has a rear opening that permits an elder baby to enter without obstacle to learn walking therein by grabbing the rear end of the upper tray, when the upper tray is moved to a second position from a first position. Each of the pair of side posts is connected between the upper tray and the base for positioning the baby walker in a selected height.

11 Claims, 8 Drawing Sheets

BABY WALKER WITH A USE-TRANSFERABLE UPPER TRAY

CROSS-REFERENCE TO RELATED APPLICATIONS

This non-provisional application claims priority under 35 U.S.C. §119(a) on Patent Application No. 201020268412.0 filed in China on Jul. 22, 2010, the entire contents of which are hereby incorporated by reference.

BACKGROUND OF THE INVENTION

1. Field of the Invention

The present invention relates generally to a baby walker, especially to a baby walker provided with an upper tray which has a first position for installing a seat for accommodating a baby-occupant sitting thereon and a second position for providing a hand-grabbable rear end and an opening space behind the seat for receiving and protecting an elder baby learning walking inside.

2. Description of the Related Art

Baby walker is generally used for baby who has not yet developed the ability to walk. As the baby occupant is growing day by day, the walker needs to be adjustable on the height to meet the need in different baby growing stages.

However such a traditional baby walker has only single use, when the baby has grown up, the baby walker normally become a useless obstacle at home. To convert the baby walker into other use is important, for example, to transfer its use as a toy vehicle that can be pushed and moving around in the living room, or some time to use as a chair for feeding.

SUMMARY OF THE INVENTION

For approaching this improvement goal, the present invention provides a simple, economical but more useful baby walker structure with a use-transferable upper tray, which comprises an upper tray, a base, a pair of side posts and a positioning mechanism. The upper tray is connected with a seat for accommodating a baby-occupant sitting thereon for feeding foods, like the use of a normal high chair. The base has a plurality of wheels for contacting the ground, thereby permitting an elder baby to push and move the baby walker easily. Each of the pair of side posts is connected between the upper tray and the base for positioning the baby walker in a selected height. The positioning mechanism is capable of positioning the upper tray relative to the base in a first position and a second position, wherein the second position is forward relative to the first position. When the upper tray is in the second position, it allows the elder baby to enter and learning walking inside an opening space behind the seat, where the upper tray provides a hand-grabbable rear end is reachable by the elder baby's hand.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention; examples of which are illustrated in the accompanying drawings.

Figure 1:
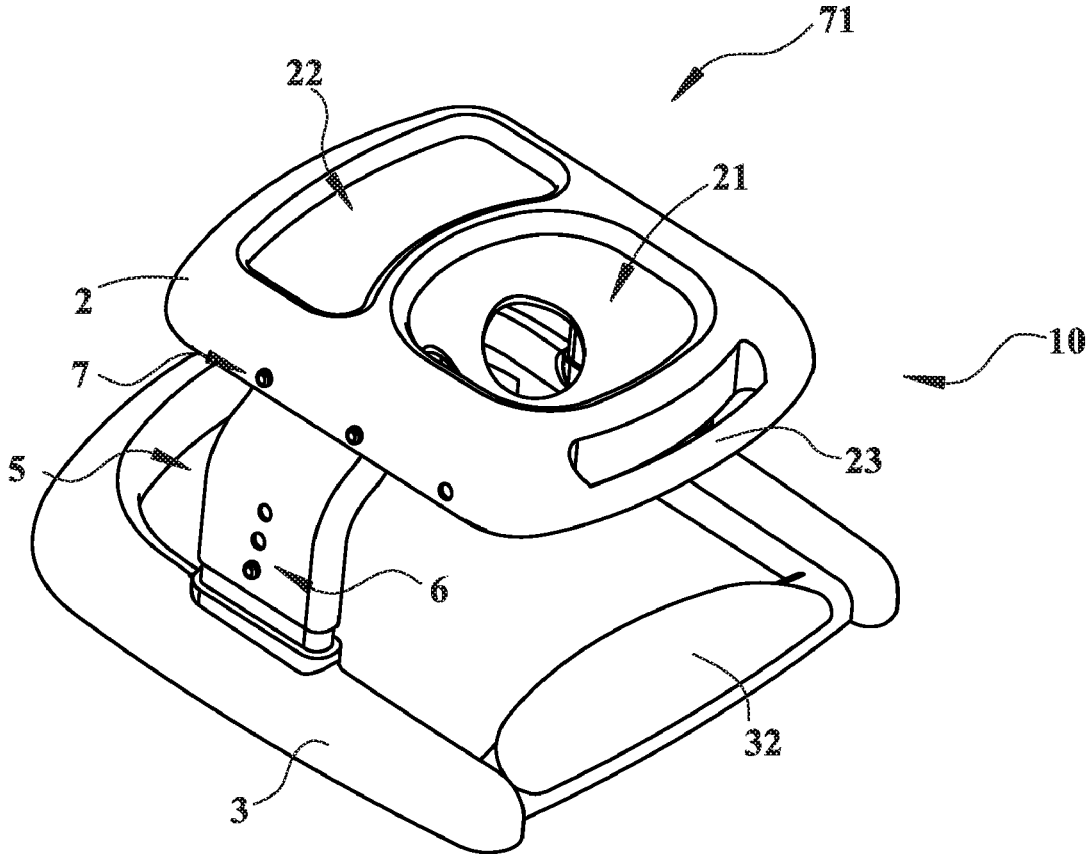
FIG. 1 is a perspective view showing an embodiment of the baby walker with a playing tray at the rear end of the base thereof, according to the present invention.

Referring to FIG. 1, an embodiment of the baby walker 10 according to the present invention, may be detachably equipped with a playing tray 32 on the rear lower portion.

Figure 2:
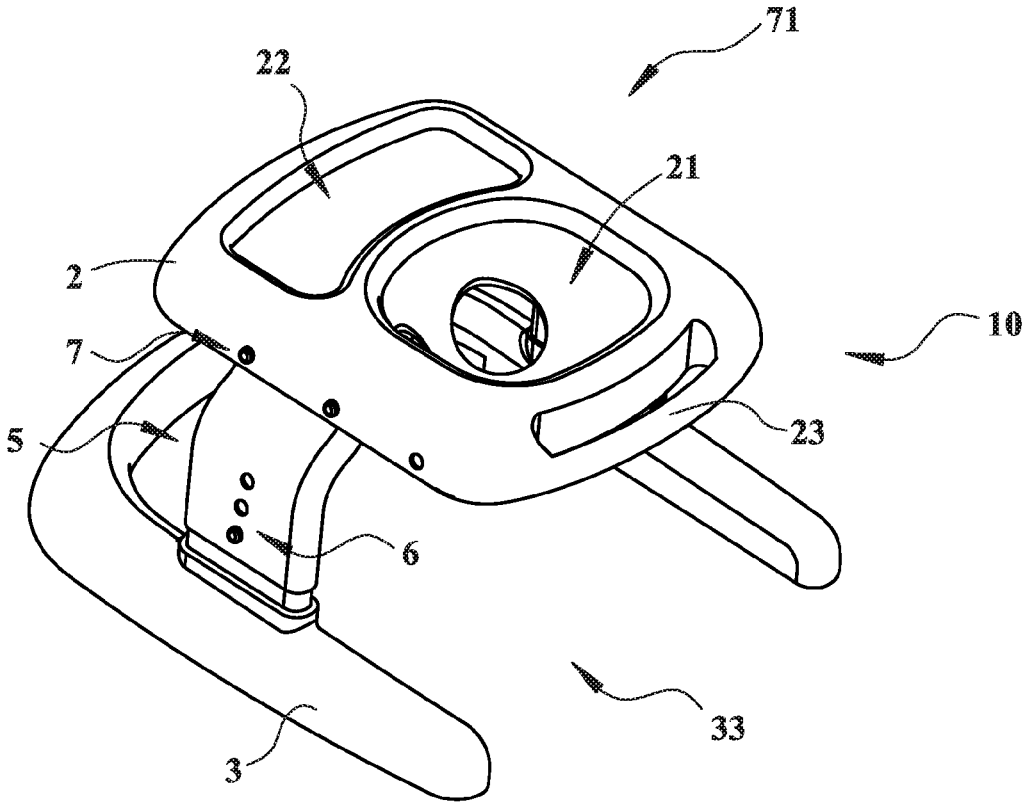
FIG. 2 is a perspective view showing an alternative embodiment of the baby walker without the playing tray at the rear end of the base, and the rear end of the base is formed with a opening space for permitting an elder baby to walk in and learning walking inside the opening space by grabbing the rear portion of the upper tray of the baby walker.

Referring to FIGS. 1 and 2, the baby walker 10 according to the present invention may basically comprises an upper tray 2, a base 3, a pair of side posts 5 and a positioning mechanism 7.

The upper tray 2 is connected with a seat 21 for accommodating a baby-occupant sitting thereon for feeding foods. Preferably, the front portion of the upper tray 2 is formed as a food tray for learning eating or a playing tray for playing toys when a baby occupant is sitting on the seat 21.

Referring to FIGS. 3 to 8, the base 3 has a plurality of wheels 31 for contacting the ground, thereby permitting an elder baby or small child to push and move the baby walker 10 on the ground easily. Preferably, the rear portion of base 3 is formed with an opening space 33 for receiving an elder baby to enter and walking inside the opening space 33 without obstacle.

Each of the pair of side posts 5 is connected between the upper tray 2 and the base 3 for positioning the baby walker 10 in a selected height. For adjusting the height of the upper tray 2, each of the side posts 5 may comprise an upper section 51 and a lower section 52, so as to retractably provide an adjustment function in height by manipulating a height adjusting mechanism 6.

Figure 3:
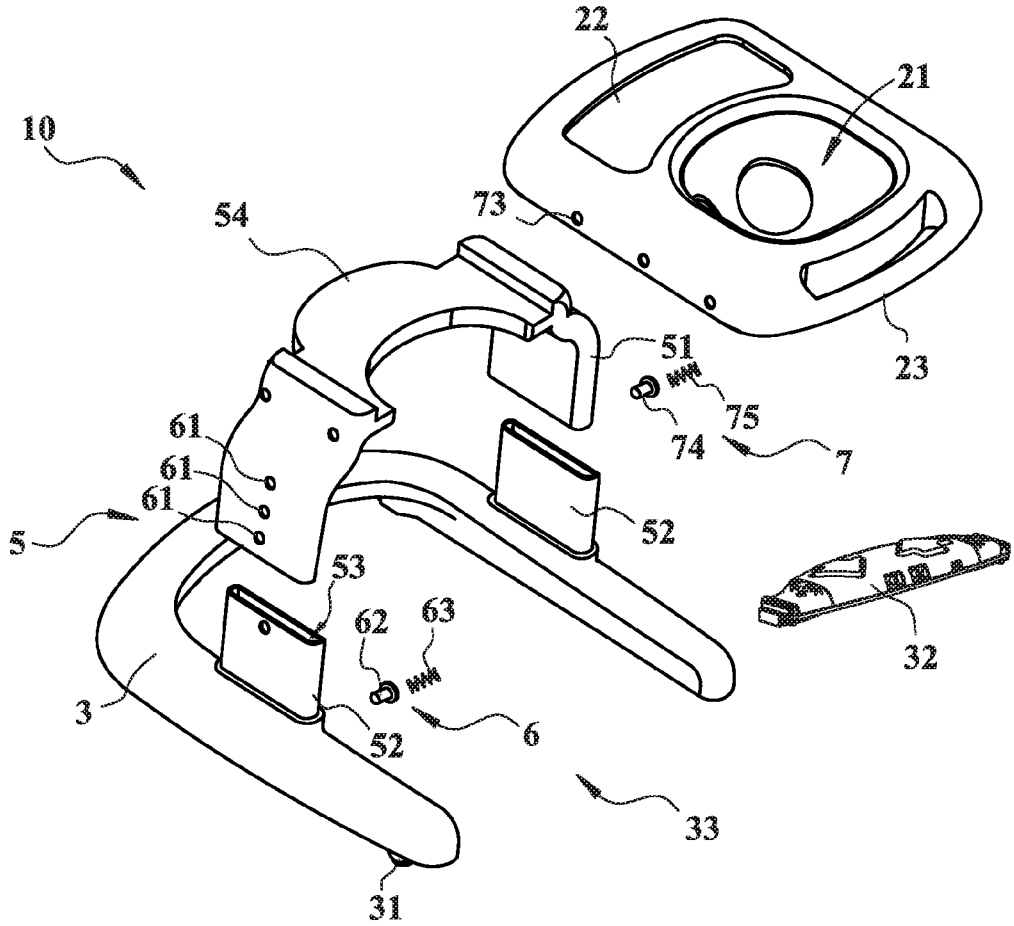
FIG. 3 another exploded perspective view showing an embodiment of the baby walker according to the present invention.
Figure 4:
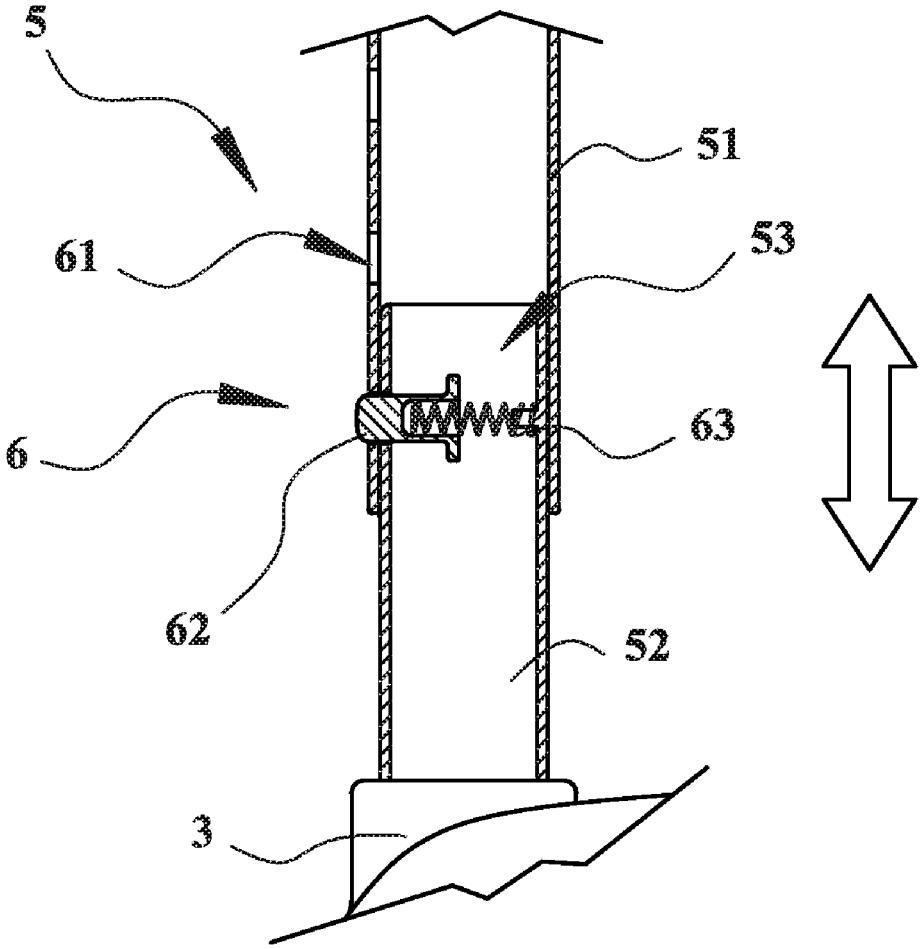
FIG. 4 is a cross-sectional view showing the operation of adjusting the height of the upper tray.
Figure 5:
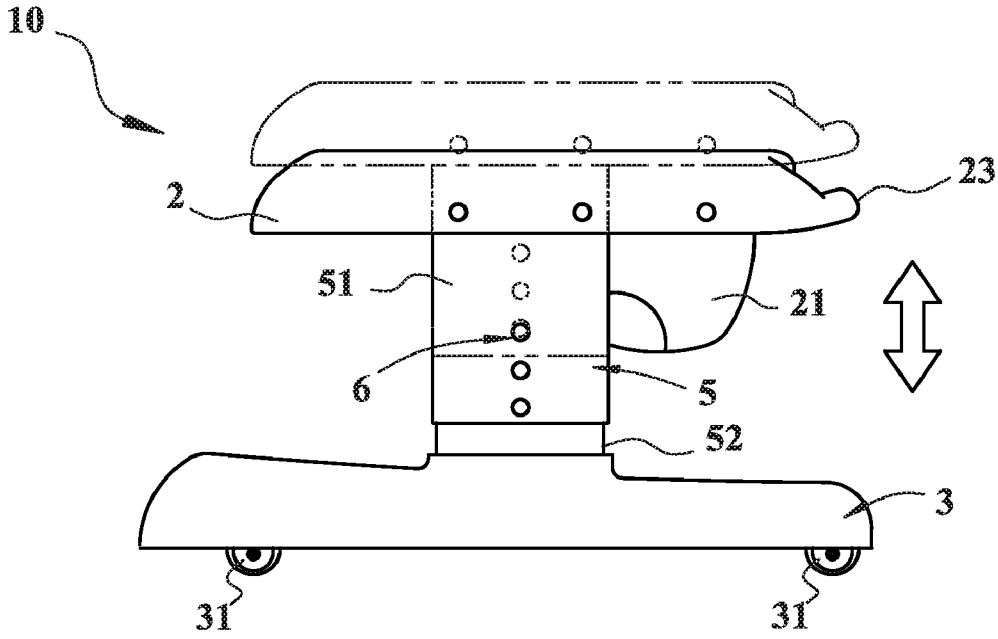
FIG. 5 is a side view showing the operation of adjusting the height of the upper tray.

As being illustrated in FIGS. 3 and 4, the height adjusting mechanism 6 may include at least a button 62 installed inside the upper end 53 of the lower section 52 and biased by a spring 63. The upper section 51 is punched with a plurality of locking holes 61 that can catch the button 62 for locking the side posts 5 in a selected position. This locking may be released by merely pressing the button 62 against the spring 63, so as to disengage the button 62 from the locking holes 61, and then user can proceed to the adjustment of the length of pair of side posts 5, as the operation shown in FIG. 5.

Preferably, for surely enhancing the strength of the structure, the upper section 51 can be embodied as a U-shaped structure. For instance, let the upper section 51 to comprise a transversal portion 54 that may firmly connected between or formed integrally with the two downward extending upper sections 51, as shown in FIG. 3.

The positioning mechanism 7 is capable of positioning the upper tray 2 relative to the base 3 in a first position 71 and a second position 72, wherein the second position 72 is forward relative to the first position 71. By this way, when the upper tray is positioned in the second position 72, allowing the elder baby to enter the opening space 33 of the base 3 without obstacle, and learning walking within the opening space 33 by grabbing the hand-grabbable rear end of the upper stay 2.

The upper tray 2 can be normally positioned in the first position 71 for accommodating the baby-occupant sitting in the seat 21. Further, the upper tray 2 may be repositioned to the second position 72 for receiving the elder baby inside the opening space 33 to learn walking by grabbing the rear end of the upper tray 2. Preferably, the upper tray 2 is formed with a handle portion 23 for easy holding of the elder baby.

Figure 6:
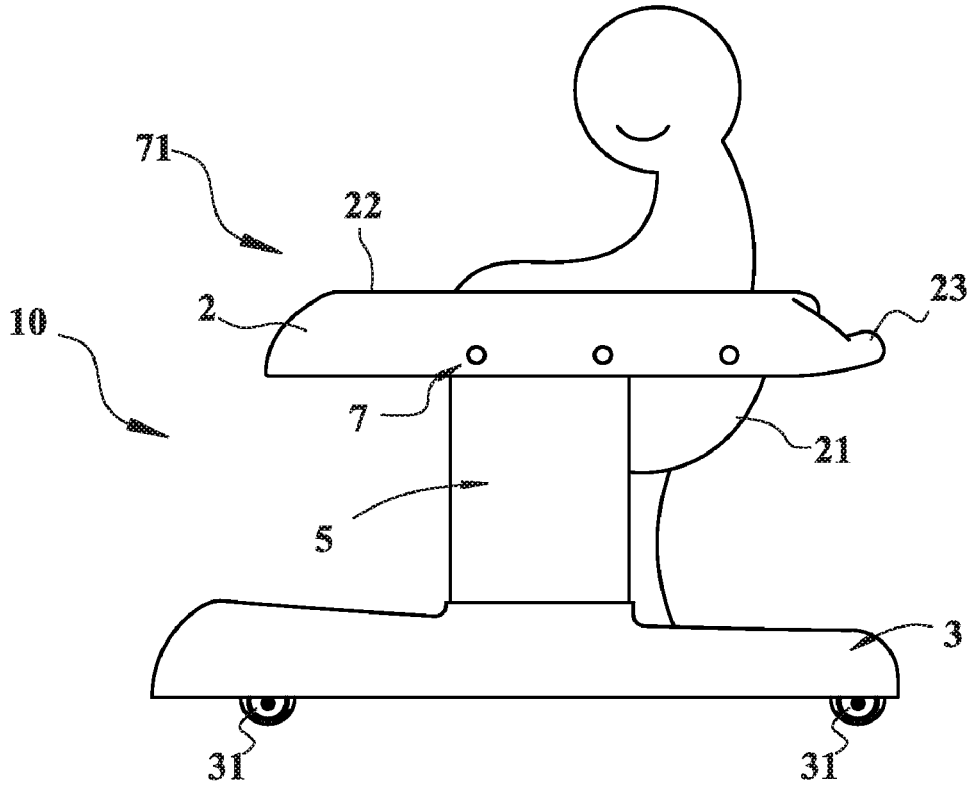
FIG. 6 is a side view showing one of the uses of the baby walker, when the upper tray is positioned in a first position.
Figure 7:
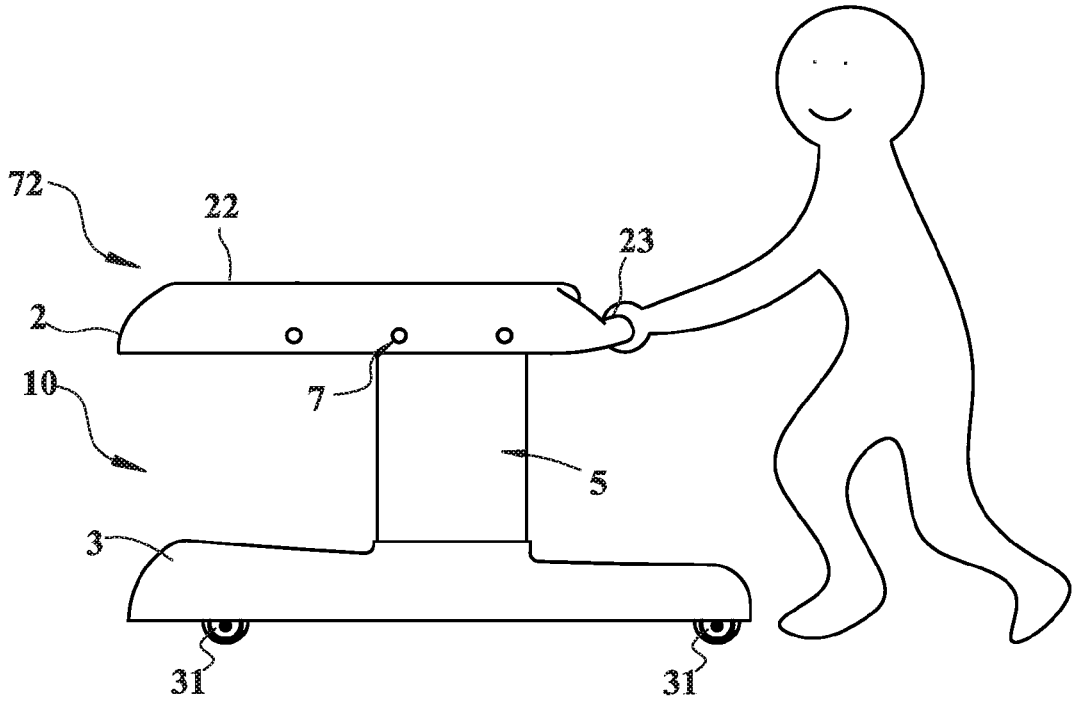
FIG. 7 is a side view showing another use of the baby walker, when the upper tray is positioned in the first position.
Figure 8:
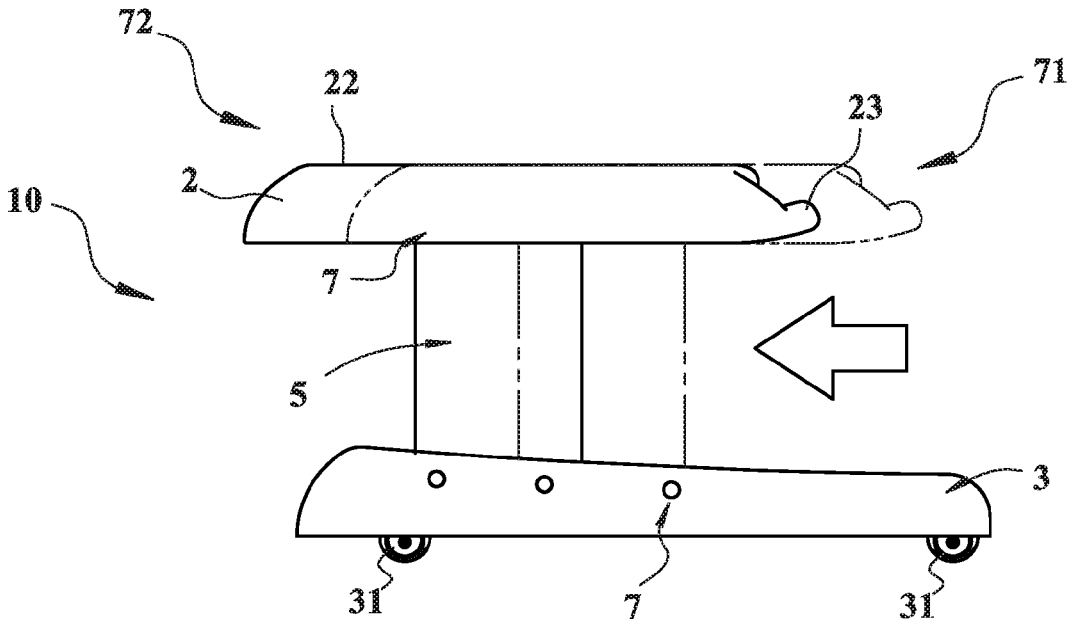
FIG. 8 is a side view showing an extra-use of the baby walker, when the upper tray is positioned in a second position.

Referring to FIG. 6, when the upper tray is positioned in first position 71, the baby walker 10 can be used as a chair for feeding and playing toy on the tray 22, or used as a toy vehicle as exampled in FIG. 7.

The positioning mechanism 7 can be operatively mounted between the upper tray 2 and the pair of side posts, as being illustrated in FIGS. 2, 3 and 7. It is apparently, any person skilled in the art would know the positioning mechanism 7 can be alternatively mounted between the pair of side posts and the base 3 as an equivalent mechanism for positioning the upper tray 2 in the first position 71 and the second position 72.

The method for reposition of the upper tray 2, includes sliding and locking the upper tray 2 between the first position 71 and the second position 72. Besides, the upper tray 2 may be alternatively embodied as capable of detaching from the first position 71 and connecting again in the second position 72.

The positioning mechanism 7 includes spring-loaded button mounted on the upper tray 2, and the side posts 5 are formed with a plurality of positioning portions 73 for engaging with the spring-loaded button 74, so as to position the upper tray 2 in the first position 71 and the second position 72.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A baby walker with a use-transferable upper tray, comprising:

an upper tray capable of being positioned in a first position and moving forward from the first position to a second position, wherein the upper tray is connected with a seat for accommodating a baby-occupant sitting thereon when being positioned in the first position;

a base having a plurality of wheels for contacting ground and a rear portion formed with an opening space for allowing an elder baby to enter therein without obstacle and learn walking within the opening space;

a pair of side posts connected between the upper tray and the base; and a positioning mechanism for positioning the upper tray relative to the base in the first position and the second position.

2. The baby walker with a use-transferable upper tray according to claim 1, wherein the positioning mechanism is operatively mounted between the upper tray and the pair of side posts.

3. The baby walker with a use-transferable upper tray according to claim 1, wherein the positioning mechanism is operatively mounted between the pair of side posts and the base.

4. The baby walker with a use-transferable upper tray according to claim 1, wherein the positioning mechanism includes spring-loaded button mounted on the upper tray, and the side posts are formed with a plurality of positioning portions for engaging with the spring-loaded button, so as to position the upper tray in the first position and the second position.

5. The baby walker with a use-transferable upper tray according to claim 1, wherein the upper tray is repositioned by sliding from and between the first position and the second position.

6. The baby walker with a use-transferable upper tray according to claim 1, wherein the upper tray is capable of detaching from the first position and connecting to the second position.

7. The baby walker with a use-transferable upper tray according to claim 1, wherein the upper tray is formed with a handle portion for grabbing by an elder baby learning walking.

8. The baby walker with a use-transferable upper tray according to claim 1, wherein the upper tray is positioned in the first position for accommodating the baby-occupant sitting in the seat.

9. The baby walker with a use-transferable upper tray according to claim 1, wherein the side posts each has a height adjusting mechanism for adjusting the upper tray in height.

10. The baby walker with a use-transferable upper tray according to claim 8, wherein the side posts each comprises an upper section and a lower section.

11. The baby walker with a use-transferable upper tray according to claim 1, wherein the upper tray is positioned in the second position for receiving the elder baby inside the opening space to learn walking by grabbing the rear end of the upper tray.

* * * * *